US005205261A

United States Patent [19]

Betts, Jr. et al.

[11] Patent Number: 5,205,261

[45] Date of Patent: Apr. 27, 1993

[54] AIR RESTRICTION DERATE FOR INTERNAL COMBUSTION ENGINES

[75] Inventors: Edward H. Betts, Jr., Chillicothe; Clark C. Schweigert, Tremont, both of Ill.

[73] Assignee: Caterpillar Inc., Peoria, Ill.

[21] Appl. No.: 909,861

[22] Filed: Jul. 7, 1992

[51] Int. Cl.[5] ..... F02M 51/00

[52] U.S. Cl. ..... 123/494

[58] Field of Search ..... 123/494, 681, 690, 479, 123/489, 478, 520; 73/861.42, 195, 196, 202

[56] References Cited

U.S. PATENT DOCUMENTS

| | | | |
|---|---|---|---|
| 4,157,701 | 6/1979 | Holtrop et al. | 123/140 |
| 4,987,877 | 1/1991 | Nakinawa | 123/494 |
| 5,007,399 | 4/1991 | Nakinawa | 123/489 |
| 5,016,595 | 5/1991 | Kawai et al. | 123/478 |
| 5,050,565 | 9/1991 | Ishihara et al. | 123/494 |
| 5,139,001 | 8/1992 | Tada | 123/520 |

*Primary Examiner*—Raymond A. Nelli
*Attorney, Agent, or Firm*—R. Carl Wilbur

[57] ABSTRACT

An apparatus is provided for operating an internal combustion engine having an inlet air filter and a plurality of solenoid operated fuel injection units adapted to receive fuel injection signals and responsively inject fuel into associated engine cylinders. The apparatus includes a sensor adapted to sense a level of clogging of the air filter and responsively produce a clogging level signal. An electronic controller is adapted to produce the fuel injection signals as a function of sensed operating parameters and in accordance with a preselected horsepower curve. The controller is further adapted to receive the clogging level signal, compare the clogging level signal to a preselected threshold and limit the maximum engine horsepower in response to the clogging level signal being equal to or greater than the preselected threshold.

14 Claims, 2 Drawing Sheets

AIR RESTRICTION DERATE FOR INTERNAL COMBUSTION ENGINES

TECHNICAL FIELD

This invention relates generally to an engine control and, more particularly, to a system which limits engine power in response to sensed air filter clogging.

BACKGROUND ART

Internal combustion engines are designed to operate in a designated range of temperatures. When engine temperature becomes excessive, even for relatively short durations, engine performance is diminished and at extreme temperatures severe engine damage can result. Such damage can include burned valves, head gasket failures, engine block distortion, cracked manifold and cylinder heads, burning and scoring of pistons, carbon deposits behind piston rings and on injector tips, piston ring failures with resultant high oil consumption and blow by, lubrication oil dilution, cracks in the turbocharger unit and expansion of aluminum pistons resulting in aluminum deposits on the cylinder walls and piston seizure.

A common cause of excessive engine temperatures is air filter clogging. As the air filter becomes clogged, the available inlet air is decreased and the air/fuel ratio can become too rich, thereby causing the engine temperature to increase. If the operator neglects to change a clogged filter, the engine temperature can reach levels sufficient to cause the above-mentioned damage.

The present invention is directed to overcoming one or more of the problems set forth above by providing a system which detects filter clogging and reduces the available engine power. The present invention has at least two advantages over known systems. First, by limiting engine power when the filter is clogged, the engine temperature can be maintained at levels below those where damage results. Second, the system "encourages" the operator to replace a clogged filter by preventing full power operation of the vehicle as the filter clogging increases.

DISCLOSURE OF THE INVENTION

An apparatus is provided for operating an internal combustion engine having an inlet air filter and a plurality of solenoid operated fuel injection units adapted to receive fuel injection signals and responsively inject fuel into associated engine cylinders. The apparatus includes a sensor adapted to sense a level of clogging of the air filter and responsively produce a clogging level signal. An electronic controller is adapted to produce the fuel injection signals as a function of sensed operating parameters and in accordance with a preselected horsepower curve. The controller is further adapted to receive the clogging level signal, compare the clogging level signal to a preselected threshold and limit the maximum engine horsepower in response to the clogging level signal being equal to or greater than the preselected threshold.

BEST MODE FOR CARRYING OUT THE INVENTION

Figure 1:
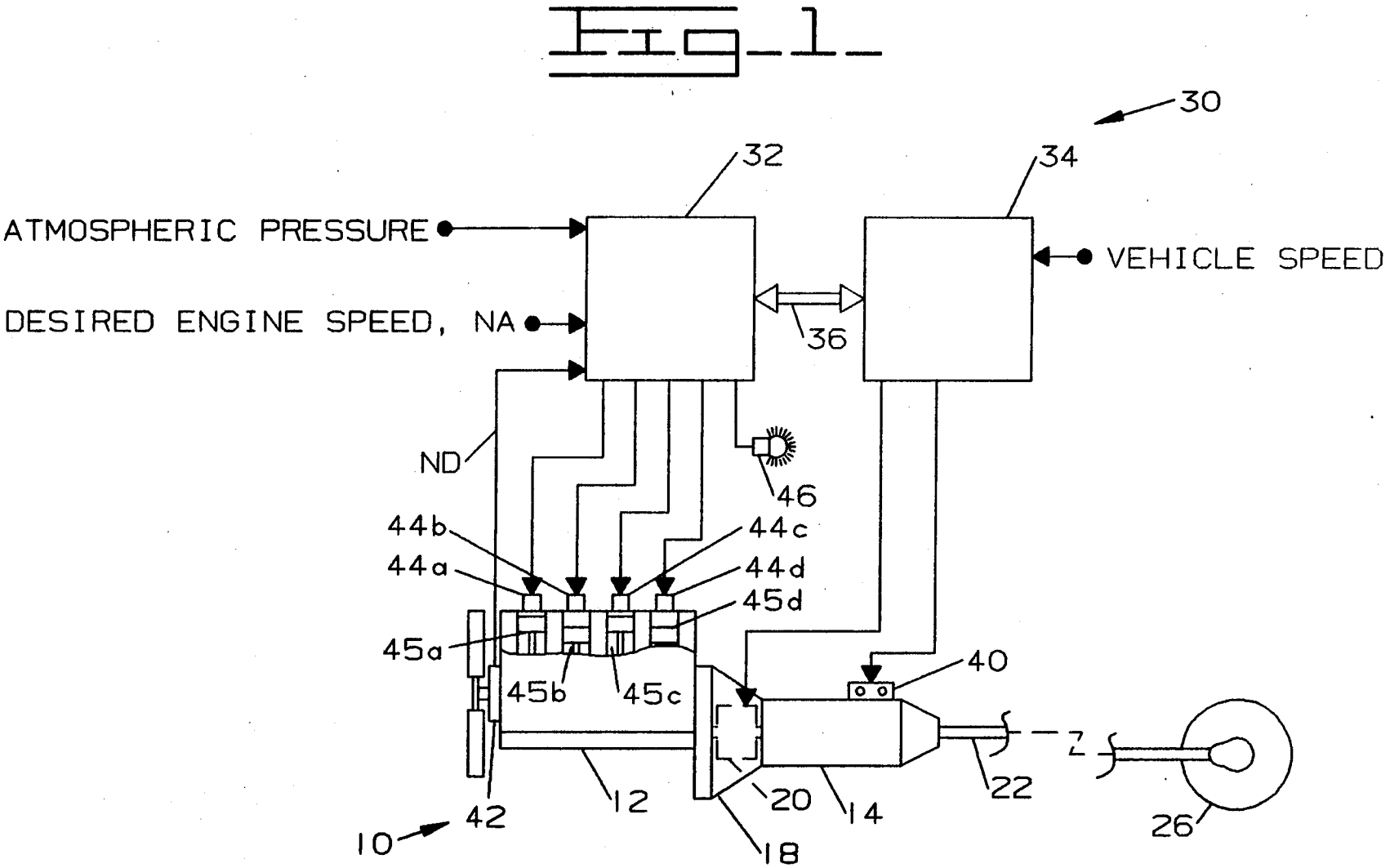
FIG. 1 is a schematic illustration of a vehicle control system incorporating the present invention.

Referring now to FIG. 1, the present invention will be described. FIG. 1 is a schematic illustration of a vehicle power plant 10 to which the present invention can be applied. The power plant 10 is equipped with an engine 12 and an automatic transmission 14. The input of the transmission 14 is connected to and driven by the engine 12 through a torque converter 18 equipped with a lock-up clutch 20. The output of the transmission 14 is connected to and adapted to rotatably drive a shaft 22. The shaft 22 is in turn connected to and adapted to drive a ground engaging wheel 26, thereby propelling the vehicle. In this manner, engine torque or power is transmitted to the wheel 26 with a predetermined speed ratio.

A vehicle control system 30 includes engine and transmission controllers 32,34 which are embodied in separate microprocessors adapted to communicate via a data link 36. Numerous commercially available microprocessors can be adapted to perform the functions of the engine and transmission controllers, as would be apparent to one skilled in the art. However, preferably the microprocessors are series MC68HC11 as manufactured by Motorola, Inc. of Schaumburg, Ill. It should be appreciated that both controllers could readily be embodied in a single microprocessor without departing from the scope of the present invention.

The transmission controller 34 is adapted to receive inputs including a vehicle speed signal, and effect gear changes in the transmission 14 in response to the received signals and in accordance with a predetermined shifting strategy, as is common in the art. For this purpose, the transmission 14 is provided with plurality of shift solenoids 40 which are adapted to receive a transmission control signal from the transmission controller 34 and responsively control transmission gear ratio. The transmission controller 34 is also electrically connected to the lock-up clutch 20 for controlling its engagement and disengagement during shifting in accordance with a preselected strategy. Since operation of the transmission 14 forms no part of the present invention, no further description is provided.

The engine controller 32 is adapted to receive operating parameters including a desired engine speed signal $N_D$ and an actual engine speed signal $N_A$ and responsively regulate engine speed in a closed-loop control. For this purpose, the control system includes an engine sensor 42 which is adapted to sense engine speed and produce an engine speed signal. Preferably, the engine speed sensor 42 is in the form of a magnetic pick-up sensor adapted to produce a signal corresponding to the rotational speed of the engine 12. One suitable sensor is described in U.S. Pat. No. 4,972,332 which issued to Luebbering et al. on Nov. 20, 1990. The sensor disclosed therein is capable of determining the speed, angular position and direction of rotation of a rotatable shaft.

The engine controller 32 processes the received signals to produce a fuel injection control signal $I_{fuel}$ for regulating the fuel delivery to the engine in response to a difference (i.e., error) between the desired and actual engine speed signals and in accordance with horsepower map (not shown) as is common in the art. Preferably, actual engine speed is regulated into correspondence with the desired engine speed using a proportional-integral-differential (PID) control loop. While a PID loop is preferred, it should be appreciated that the present invention could readily be adapted for use with other control strategies such as a proportional-integral control.

The injection control signal $I_{fuel}$ is delivered to solenoid operated fuel injector units 44a–d associated with individual engine cylinders 45a–d (four shown for illustration purposes) of the engine 12. The duration of the injection control signal corresponds to the on-time of the solenoid, thereby controlling the duration for which the injector delivers fuel to associated cylinder during the combustion cycle. Solenoid operated fuel injectors of this type are well known in the art and it is perceived than any of them can be used with the present invention. One suitable solenoid operated fuel injector is shown in U.S. Pat. No. 4,219,154 which issued Aug. 26, 1980 to Douglas A. Luscomb. It discloses a solenoid controlled, hydraulically actuated unit injector. Another suitable solenoid is shown in U.S. Pat. No. 4,653,455, issued Mar. 31, 1987 to Eblen et al. It discloses a solenoid controlled, mechanically actuated unit injector.

Normally, the desired engine speed signal $N_D$ is responsive to the position of the accelerator pedal. For this purpose, the control system 30 includes a pedal position sensor (not shown) which is adapted to produce an electrical signal responsive to the position of the accelerator pedal. One suitable position sensor for performing this function is disclosed in U.S. Pat. No. 4,915,075 which issued to Brown on Mar. 20, 1989. During shifting, engine speed is regulated in accordance with a desired engine speed signal as produced by the transmission controller 34. More specifically, during shifts the transmission controller 34 produces a desired engine speed signal $N_D$ in accordance with a preselected strategy which limits the desired engine speed, thereby reducing the driveline torques and clutch thermal loads developed during shifting. This desired engine speed signal is delivered to the engine controller 24 which takes control away from the accelerator pedal and regulates engine speed in accordance with the desired engine speed signal received from the transmission controller 34. Upon completion of a shift, control of engine speed is returned to the accelerator pedal. Inasmuch as the integrated engine-transmission control strategy forms no part of the present invention and such systems are well known in the art, no further explanation is provided. A typical integrated control is generally described in U.S. Pat. No. 4,819,777 which issued on Apr. 11, 1989 to Yasue et al.

The control system 30 further includes means for sensing the level of clogging of the air filter and responsively producing a clogging level signal. Preferably, this means including inlet and outlet air pressure sensors (not shown) adapted to produce electrical signals corresponding to the inlet and outlet pressures of the engine's air filter (not shown), respectively. In the preferred embodiment the inlet and outlet air pressure sensors are in the form of an atmospheric air pressure sensor and a turbocharger inlet pressure sensor, respectively. Since the air filter is disposed up stream from the turbocharger, the sensed turbocharger inlet pressure corresponds to the air filter outlet pressure. Moreover, the atmospheric pressure is equal to the air pressure of air supplied to the air filter. It should be appreciated that the functions of these sensors could also be performed using sensors located at the inlet and outlet of the air filter. However, in applicant's control system it is advantageous to use the atmospheric pressure sensor and the turbocharger inlet pressure sensor because these sensors are required for other control functions which are not described herein. Both sensors are in the form of absolute pressure sensors which are adapted to produce electrical signals, such as analog voltage signals, which correspond to the sensed air pressure in kilopascals (kPa). Numerous commercially available sensors are suitable for performing these functions; therefore, no further detail is provided. One such sensor is a model 2071B as manufactured by Texas Instruments, Inc. It should be appreciated that sensors producing other electrical outputs, such as a pulse-width-modulated signal, are within the scope of the present invention.

The controller 24 is adapted to receive the inlet and outlet air pressure signals and produce a filter clogging level signal in response to a difference between the air filter outlet and inlet pressure signals. The clogging level signal is compared to a preselected threshold (T1) which corresponds to a pressure drop across the filter at which the filter is clogged to the point of needing replacement. The present invention was developed for use on a series 3508 engine as manufactured by Caterpillar, Inc. of Peoria, Ill. On that engine, the preselected threshold (T1) corresponds to 6.25 kPa. It should be appreciated that the exact value of the preselected threshold (T1) needs to be empirically determined in accordance with the engine being used. As the clogging level signal increases past the preselected threshold (T1), the maximum available engine power is proportionally reduced up to a maximum reduction of 20 percent (i.e., 80 percent maximum horsepower).

More specifically, based upon theoretical and empirical data, it has been determined that engine exhaust temperature increases linearly as inlet restriction increases. Although this relationship is approximately a 1:1 ratio, engine power is derated 2 percent for every 1 KPa increase in air inlet restriction above the preselected threshold (T1). This strategy is employed for two reasons. First, this "conservative" approach reduces the likelihood of engine damage resulting for excessive operating temperatures. Second, it "encourages" the vehicle operator to replace the air filter before it becomes fully clogged.

The engine controller 32 is also adapted to produce a clogged filter signal in response the clogging level signal exceeding the preselected threshold (T1). The clogged filter signal is supplied to a warning indicator 46, such as a warning lamp, for indicating that the air filter needs to be replaced.

Figure 2:
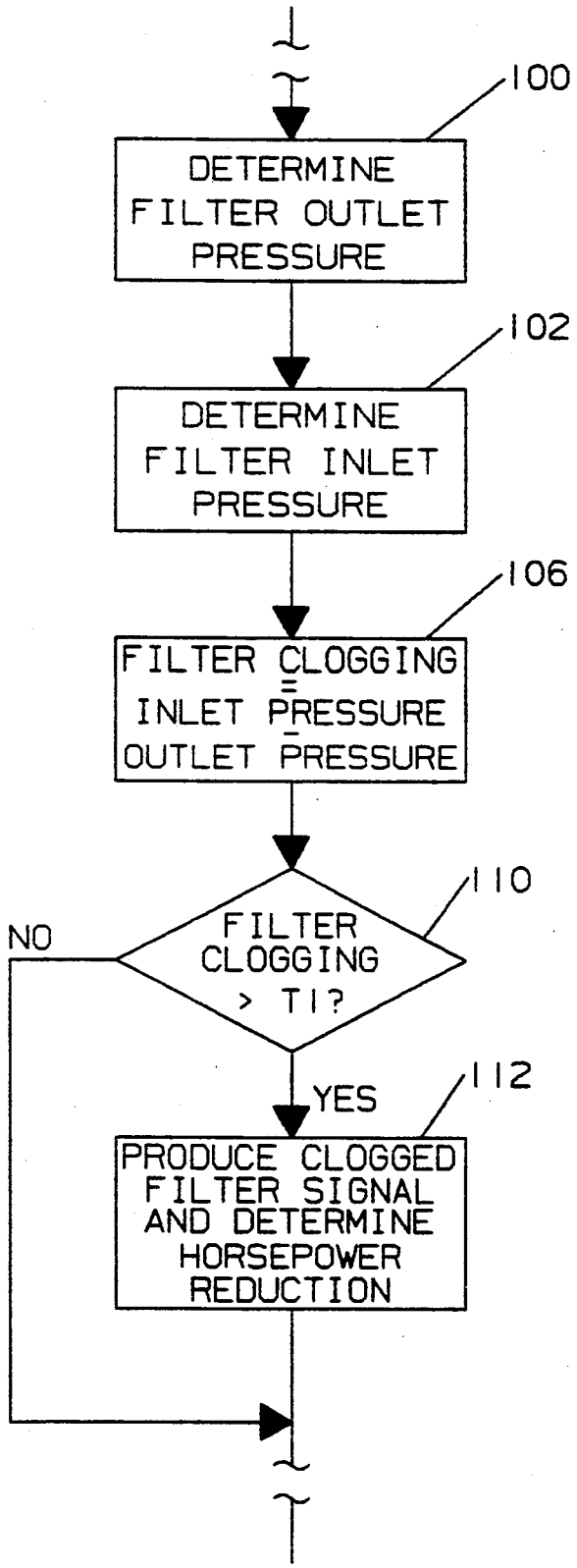
FIG. 2 is a software flowchart for practicing certain aspects of the present invention.

Referring now to FIG. 2, an embodiment of software for programming the engine controller 32 in accordance with certain aspects of the immediate invention is explained. FIG. 2 is a flowchart illustrating a computer software program for implementing the preferred embodiment of the present invention. The flowchart depicted in this figure is particularly well adapted for use with the microprocessor and associated components described above, although any suitable microprocessor may be utilized in practicing an embodiment of the present invention. This flowchart constitutes a complete and workable design of the preferred software program, and has been reduced to practice on the series MC68HC11 microprocessor. The software program may be readily coded from this flowchart using the instruction set associated with this system, or it may be coded with the instructions of any other suitable conventional microprocessors. The process of writing software code from a flowchart such as these is a mere mechanical step for one skilled in the art.

Initially, in the block 100, the controller 32 senses the air filter outlet pressure as indicated by the turbocharger inlet sensor. Control is then passed to the block 102 where the controller 32 senses the air filter inlet pressure as indicated by the atmospheric pressure sensor. Next control is passed to the block 106 where the filter clogging level signal is produced in response to the difference between the air filter inlet and outlet pressures. This signal corresponds to air pressure drop across the air filter in kilopascals. Subsequently, in the block 110, the controller 32 compares the filter clogging level signals to the preselected threshold (T1) to determine if the filter needs to be replaced. If the filter clogging signal is less than the preselected threshold (T1) the filter does not need to be replaced and control is returned to the block 100. However, if the clogging level signal equals or exceeds the preselected threshold (T1), the filter is assumed to be clogged and control is passed to the block 112.

In the block 112, the controller 32 produces the clogged filter signal, thereby causing the warning indicator 46 to be activated. Preferably the warning indicator 46 remains active until the engine controller 32 is powered off, i.e., until the engine 12 is turned off. Additionally in the block 112, the engine controller 32 responsively limits the available engine power to a preselected percentage of its maximum in response to the level of clogging. Preferably the available power is proportionally reduced as filter clogging increases above the preselected threshold (T1). More specifically, the controller 32 reduces the maximum value (i.e. duration) of the injection signal by preselected amount for every kilopascal that the clogging level signal exceeds the preselected threshold (T1). In the preferred embodiment the available power is reduced by 2 percent per kilopascal over the preselected threshold (T1) up to a maximum reduction of 20 percent in available engine power (i.e., horsepower is limited to 80 percent of maximum). The percentage of engine power reduction determined in block 112 is latched in memory and is utilized to limit fuel to the engine until the engine is turned off.

INDUSTRIAL APPLICABILITY

Assume the present invention is installed on a vehicle such as an off-highway dump truck. With time particulates collect in the engine's air filter and the inlet air available to the engine 12 is decreased. If the air filter is allowed to become excessively clogged, insufficient air is supplied to the engine causing an excessively rich air/fuel ratio which results in an elevated engine operating temperature and reduced engine performance. Operating an engine at excessive temperatures can result in severe engine damage, as set forth above.

The present invention is operative to reduce the likelihood of engine damage resulting from operating the vehicle with a clogged air filter. The engine controller 32 continuously monitors the air pressure drop across the engine air filter. This is accomplished by measuring the pressure differential between the atmospheric air pressure and the turbocharger's inlet air pressure. A filter clogging level signal is produced in response to a difference between the inlet and outlet air pressures, and this signal is processed to determine if the filter needs to be replaced. For this purpose, the filter clogging signal is compared to a preselected threshold (T1) which corresponds to a maximum desired pressure drop across the filter (i.e., a maximum desired level of filter clogging). When the filter clogging level signal equals or exceeds this threshold, it is assumed that the filter needs to be replaced.

If the clogging level signal equals or exceeds the preselected threshold (T1), the controller 32 is operative to produce the clogged filter signal. The clogged filter signal activates the warning indicator 46, thereby notifying the vehicle operator that the air filter needs to be replaced. Additionally, the controller 32 is operative to limit the available engine power in response to the level of clogging as was described above. Reducing the available engine power in response to filter clogging serves two advantageous functions. First, by limiting engine power when the filter is clogged, the engine temperature can be maintained at levels below those where damage results. Second, the system "encourages" the operator to replace a clogged filter by preventing full power operation of the vehicle when the filter is clogged.

Other aspects, objects and advantages can be obtained from a study of the drawings, the disclosure and the appended claims.

We claim:

1. A method of operating an internal combustion engine having an inlet air filter and a plurality of solenoid operated fuel injection units adapted to receive fuel injection signals and responsively inject fuel into associated engine cylinders, wherein the engine is controlled by an electronic controller that produces the fuel injection signals as a function of sensed operating parameters and in accordance with a preselected horsepower curve, comprising the steps of:

sensing the level of clogging of the air filter and responsively producing a clogging level signal;

comparing the clogging level signal to a preselected value and limiting the maximum engine horsepower in response to the clogging level signal being greater than or equal to the preselected threshold.

2. A method as set forth in claim 1 further including the steps of:

sensing the pressure of air flowing into the air filter and responsively producing an inlet air pressure signal;

sensing the pressure of air flowing out of the air filter and responsively producing an outlet air pressure signal; and producing the clogging level signal in response to a difference between the inlet and outlet air pressure signals.

3. A method as set forth in claim 2, wherein the maximum available engine horsepower is proportionally decreased as the clogging level signal increases above the preselected threshold.

4. A method as set forth in claim 3, wherein the maximum available engine horsepower proportionally decreased up to a preselected maximum power reduction.

5. A method as set forth in claim 1, wherein the magnitude of the fuel injection signals is limited in response to the clogging level signal being greater than or equal to the preselected threshold.

6. An apparatus for operating an internal combustion engine having an inlet air filter and a plurality of solenoid operated fuel injection units adapted to receive fuel injection signals and responsively inject fuel into associated engine cylinders, comprising:

sensor means for sensing a level of clogging of the air filter and responsively producing a clogging level signal;

an electronic controller adapted to produce the fuel injection signals as a function of sensed operating parameters and in accordance with a preselected horsepower curve, the controller further being adapted to receive the clogging level signal, compare the clogging level signal to a preselected threshold and limit the maximum engine horsepower in response to the clogging level signal being equal to or greater than the preselected threshold

7. An apparatus as set forth in claim 6, wherein the sensor means includes:

a first sensor adapted to sense the pressure of air flowing into the air filter and responsively produce an inlet air pressure signal;

a second sensor adapted to sense the pressure of air flowing out of the air filter and responsively produce an outlet air pressure signal; and wherein the controller is adapted receive the inlet and outlet air pressure signals and produce the clogging level signal in response to a difference between the inlet and outlet air pressure signals.

8. An apparatus as set forth in claim 7, wherein the controller is adapted to proportionally reduce the maximum available engine horsepower as the clogging level signal increases above the preselected threshold.

9. An apparatus as set forth in claim 8, wherein the controller is adapted to proportionally reduce the maximum available engine horsepower up to a preselected maximum horsepower reduction.

10. An apparatus as set forth in claim 6, wherein the controller is adapted to limit the maximum value of the fuel injection signals in response to the clogging level signal being greater than or equal to the preselected threshold.

11. An apparatus for operating an internal combustion engine having an inlet air filter and a plurality of solenoid operated fuel injection units adapted to receive fuel injection signals and responsively inject fuel into associated engine cylinders, comprising:

a first sensor adapted to sense the pressure of air flowing into the air filter and responsively produce an inlet air pressure signal;

a second sensor adapted to sense the pressure of air flowing out of the air filter and responsively produce an outlet air pressure signal;

an electronic controller adapted to produce the fuel injection signals as a function of sensed operating parameters and in accordance with a preselected horsepower curve, the controller further being adapted to receive the inlet and outlet air pressure signals and produce the clogging level signal in response to a difference between the inlet and outlet air pressure signals, compare the clogging level signal to a preselected threshold and limit the maximum engine horsepower in response to the clogging level signal being equal to or greater than the preselected threshold.

12. An apparatus as set forth in claim 11, wherein the controller is adapted to proportionally reduce the maximum available engine horsepower as the clogging level signal increases above the preselected threshold.

13. An apparatus as set forth in claim 11, wherein the controller is adapted to proportionally reduce the maximum available engine horsepower up to a preselected maximum horsepower reduction.

14. An apparatus as set forth in claim 11, wherein the controller is adapted to limit the maximum value of the fuel injection signals in response to the clogging level signal being greater than or equal to the preselected threshold.

* * * * *